US010835835B2

(12) United States Patent
Lee

(10) Patent No.: US 10,835,835 B2
(45) Date of Patent: Nov. 17, 2020

(54) SWING-TYPE EXPERIENCE APPARATUS AND METHOD OF CONTROLLING THE SAME

(71) Applicant: WABADADA CO., LTD., Gangneung-si (KR)

(72) Inventor: Kwang-Pyo Lee, Gangneung-si (KR)

(73) Assignee: WABADADA CO., LTD., Gangneung-si (KR)

( * ) Notice: Subject to any disclaimer, the term of this patent is extended or adjusted under 35 U.S.C. 154(b) by 0 days.

(21) Appl. No.: 16/489,739

(22) PCT Filed: Nov. 20, 2017

(86) PCT No.: PCT/KR2017/013181
§ 371 (c)(1),
(2) Date: Aug. 29, 2019

(87) PCT Pub. No.: WO2019/031653
PCT Pub. Date: Feb. 14, 2019

(65) Prior Publication Data

US 2020/0230507 A1 Jul. 23, 2020

(30) Foreign Application Priority Data

Aug. 7, 2017 (KR) ..... 10-2017-0099728

(51) Int. Cl.
*A63H 17/30* (2006.01)
*A63G 9/08* (2006.01)
*A63G 9/16* (2006.01)

(52) U.S. Cl.
CPC ..... *A63G 9/08* (2013.01); *A63G 9/16.* (2013.01)

(58) Field of Classification Search
USPC ..... 446/64, 119, 188, 192, 397; 482/23, 24, 482/38, 43; 417/16, 44, 45, 117–125,
(Continued)

(56) References Cited

U.S. PATENT DOCUMENTS 2,123,233 A * 7/1938 Crawford ..... A63G 9/00 482/24
2,564,547 A * 8/1951 Schrougham ..... A63G 9/16 472/119

(Continued)

FOREIGN PATENT DOCUMENTS

CN 106362405 A 2/2017
JP H06-339578 A 12/1994

(Continued)

*Primary Examiner* — Nini F Legesse
(74) *Attorney, Agent, or Firm* — Rabin & Berdo, P.C.

(57) ABSTRACT

The present invention provides a swing-type experience apparatus including: two vertical columns (110) configured to be vertically installed into the ground; a driving device (120) configured to be provided on the upper end of any one of the two vertical columns; a rotating shaft (130) configured to be provided on the upper ends of the two vertical columns in a lateral direction and to be rotated by the driving device; two vertical bars (150) configured such that one end of each thereof is fastened to the rotating shaft and the other end of each thereof is connected to a horizontal bar (140); wherein the driving device includes a motor (121) and a clutch (125) configured to selectively transmit the rotating force of the motor and then transfer the rotating force to the rotating shaft (130).

1 Claim, 8 Drawing Sheets

(58) Field of Classification Search
USPC ..... 417/128, 137
See application file for complete search history.

(56) References Cited

U.S. PATENT DOCUMENTS

| | | | | | |
|---|---|---|---|---|---|
| 4,036,489 | A * | 7/1977 | Potyondy | A63G 9/08 | 472/44 |
| 4,442,823 | A * | 4/1984 | Floyd | A63B 69/406 | 124/41.1 |
| 4,911,429 | A * | 3/1990 | Ogbu | A63G 9/16 | 297/273 |
| 5,178,590 | A * | 1/1993 | Stephens | A63B 7/02 | 482/23 |
| 5,449,323 | A * | 9/1995 | Melton | A63G 9/00 | 434/55 |
| 5,833,545 | A * | 11/1998 | Pinch | A47D 13/105 | 472/119 |
| 6,932,710 | B1 * | 8/2005 | Hartin | A63B 7/00 | 472/118 |
| 2011/0263344 | A1 * | 10/2011 | Brown | A63G 9/00 | 472/118 |

FOREIGN PATENT DOCUMENTS

| | | | |
|---|---|---|---|
| JP | 2009-112702 | A | 5/2009 |
| KR | 10-2015-0137489 | A | 12/2015 |

* cited by examiner

SWING-TYPE EXPERIENCE APPARATUS AND METHOD OF CONTROLLING THE SAME

TECHNICAL FIELD

The present invention relates to a swing-type rotation experience apparatus capable of 360° rotation and a method of controlling the swing-type rotation experience apparatus, and more specifically to swing experience apparatus technology which combines a mode in which rotating force is transferred to a swing via the power of a motor and a mode in which the power of the motor is not transferred, thereby enabling an experiencing person to have an experience while enabling the experiencing person to have a feeling of actually riding on a swing.

BACKGROUND ART

Generally, a swing includes a swing frame configured to have a lateral member which is spaced apart upward from a support surface, a plurality of connection parts configured such that the upper ends thereof are connected to the lateral member, and a seat configured such that it is coupled to the lower ends of the connection parts and an experiencing person can ride thereon.

In the swing, the seat hanging from the lateral member performs pendulum movement in response to the movement generated by an experiencing person, and thus the swing moves the experiencing person back and forth, thereby enabling the experiencing person to feel as if he or she flew in the sky.

However, in the conventional swing, the seat hangs from the frame through the connection parts composed of ropes or chains, and thus an experiencing person has only an experience of simply moving back and forth via pendulum movement, with the result that problems arise in that the experience is simple and the experiencing person easily loses interest.

DISCLOSURE

Technical Problem

A problem to be solved by the present invention is to enable an experiencing person to have an experience of riding on a swing after riding the experiencing person on a swing-type experience apparatus and also to provide an experience of 360° rotation to the experiencing person while aiming to impart a feeling of actually riding on a swing by combining rotation by the experiencing person's own power and rotation by the power of a motor.

Technical Solution

The present invention provides a swing-type experience apparatus including: two vertical columns (110) configured to be vertically installed into the ground; a driving device (120) configured to be provided at the upper end of any one of the two vertical columns; a rotating shaft (130) configured to be provided at the upper ends of the two vertical columns in a lateral direction and to be rotated by the driving device; two vertical bars (150) configured such that one end of each thereof is fastened to the rotating shaft and the other end of each thereof is connected to a horizontal bar (140); wherein the driving device includes a motor (121) and a clutch (125) configured to selectively transmit the rotating force of the motor and then transfer the rotating force to the rotating shaft (130).

In addition to the scheme of transferring rotating force while selectively transmitting the rotating force by means of the clutch, various types of power transfer, power blocking and deceleration means may be provided. An example of them may be a scheme of transferring power by selectively turning on and off the power of a motor itself without providing a clutch, or may be a scheme of transferring power by using an acceleration/deceleration mechanism for a vehicle. The above-described clutch transfer scheme is an exemplary one of them.

The clutch may be a powder clutch using a magnetic iron powder, and an encoder configured to detect the rotating direction of the rotating shaft may be provided on the rotating shaft.

Furthermore, The present invention provides a method of controlling the swing-type experience apparatus, the method including: a help mode in which the rotating force of the driving device is selectively transferred to the rotating shaft through the clutch; and a non-help mode in which the rotating shaft is rotated by its own weight and inertia without the rotating force of the driving device being transferred to the rotating shaft.

The help mode may include: a clutch ON step at which, when the rotating direction of the rotating shaft detected by the encoder is a forward direction, the clutch is turned on and the rotating force of the motor is transferred to the rotating shaft; and a clutch OFF step at which, when the rotating direction of the rotating shaft detected by the encoder is a reverse direction, the clutch is turned off, and the rotating force of the motor is not transferred to the rotating shaft.

When the angle which the vertical bars (150) form with a direction perpendicular to the ground is defined as $\theta$, and when $\theta=0°$ in an initial state in which the vertical bars remain still, a positive value is assigned to $\theta$ when the vertical bars are moved and then located forward from the initial state, and a negative value is assigned to $\theta$ when the vertical bars are moved and then located rearward from the initial state, the clutch ON step of the help mode may be released as soon as a value of $\theta$ reaches a first specific value, and a current step may be switched to the clutch OFF step, and the help mode may be released as soon as a value of $\theta$ reaches a second specific value, and then a current mode may be switched to the non-help mode.

As an exemplary value thereof, the clutch ON step of the help mode may be released as soon as the value of $\theta$ reaches 90° and then a current step may be switched to the clutch OFF step, and the help mode may be released as soon as the value of $\theta$ reach 180° and then a current mode may be switched to the non-help mode.

Advantageous Effects

The swing-type experience apparatus according to the present invention is driven in such a manner that an experiencing person rides on the swing-type experience apparatus and rotation by the experiencing person's own power and rotation by the power of the motor are combined together, and thus the swing-type experience apparatus naturally provides an experience of 360° rotation while providing a feeling of actually riding on a swing, thereby providing the advantage of providing a realistic experience effect.

The present invention gives a predetermined level of assistance to an elderly person or experiencing person having difficulty rotating 360 degrees by herself or himself via the power of the motor, thereby enabling the person to have an experience of performing 360-degree rotation and also giving a sense of accomplishment to the person.

BEST MODE

The objects, particular advantages, and novel features of the present invention will become more apparent from the following detailed description and preferred embodiments taken in conjunction with the accompanying drawings. Furthermore, the terms used herein are terms defined by taking into consideration their functions in the present invention, and may vary depending on the intention or a user or operator or practice. Therefore, the definitions of such terms should be made based on the overall content of the present specification.

Figure 1:
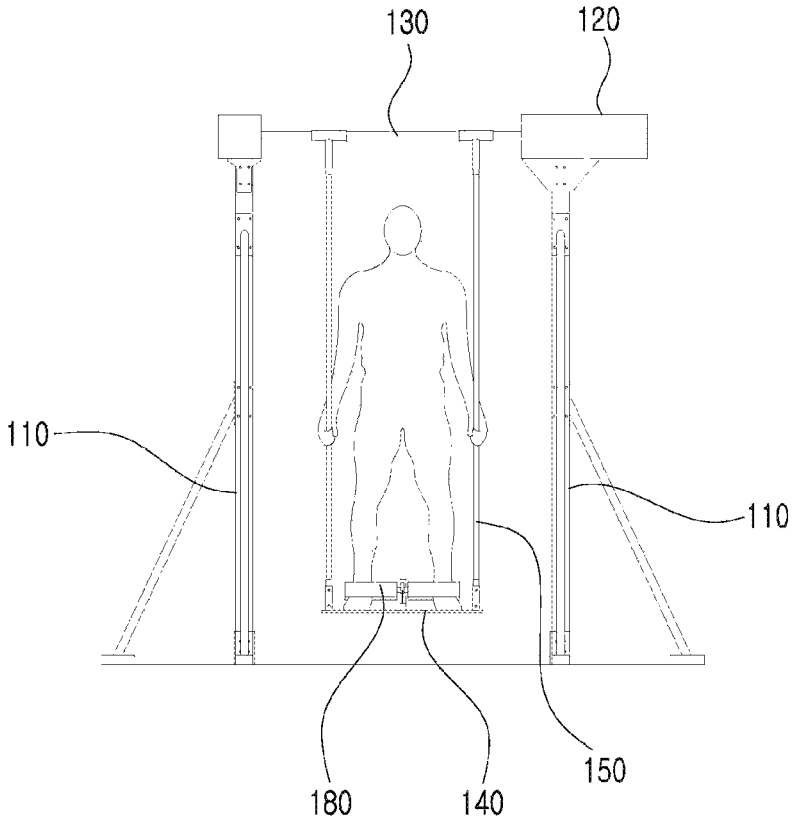
FIG. 1 shows the schematic configuration of a swing-type experience apparatus according to an embodiment of the present invention.
Figure 2:
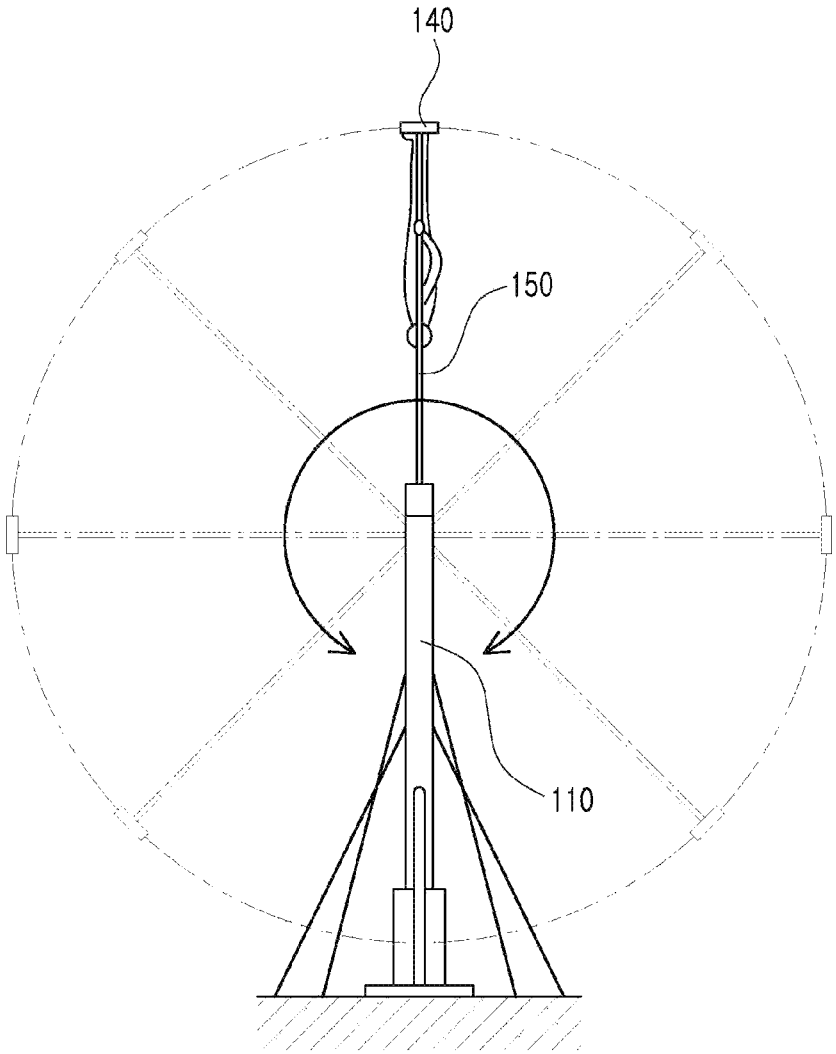
FIG. 2 shows a situation in which 360° rotation is performed using the swing-type experience apparatus according to the embodiment of the present invention.
Figure 3:
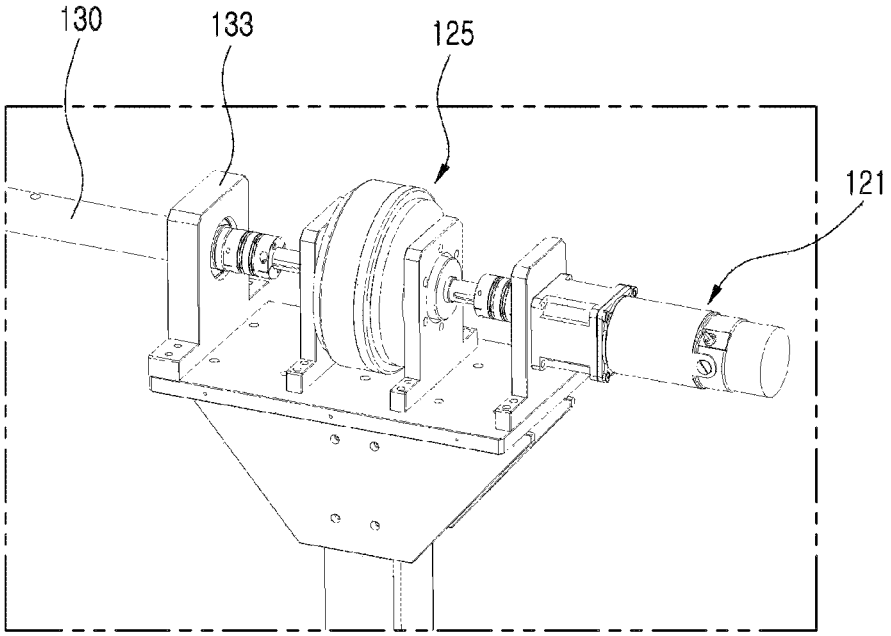
FIG. 3 shows the driving device of the swing-type experience apparatus according to the embodiment of the present invention.
Figure 4:
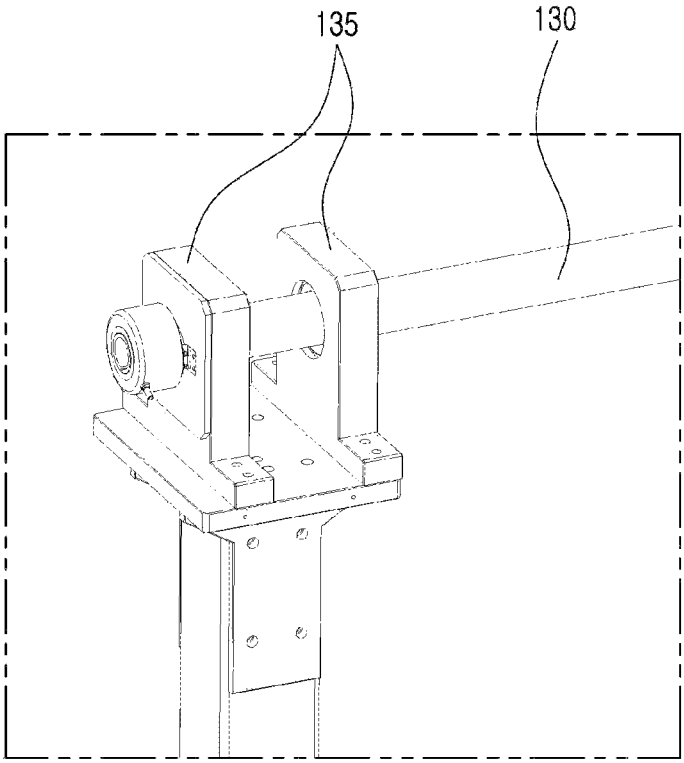
FIG. 4 shows the rotating shaft fastening device of the swing-type experience apparatus according to the embodiment of the present invention.

FIG. 1 shows the schematic configuration of a swing-type experience apparatus according to an embodiment of the present invention, FIG. 2 shows a situation in which 360° rotation is performed using the swing-type experience apparatus according to the embodiment of the present invention, FIG. 3 shows the driving device of the swing-type experience apparatus according to the embodiment of the present invention, and FIG. 4 shows the rotating shaft fastening device of the swing-type experience apparatus according to the embodiment of the present invention.

The swing-type experience apparatus according to the present invention includes two vertical columns 110 configured to be vertically installed into the ground, a driving device 120 configured to be provided at the upper end of any one of the two vertical columns, and a rotating shaft 130 configured to be provided at the upper ends of the two vertical columns in a lateral direction and to be rotated by the driving device. The rotating shaft is rotated by receiving the rotating power of the driving device, and it is characterized that the rotating shaft is rotatable by 360°.

Furthermore, the present invention further includes vertical bars 150 configured such that one end of each thereof is fastened to the rotating shaft, they are rotated along with the rotating shaft, and the other end of each thereof is coupled to a horizontal bar 140. The hands of an experiencing person hold the vertical bars, and the feet of the experiencing person are fastened to the horizontal bar. The driving device includes a motor 121 configured to generate rotating force by using power, and a clutch 125 configured to selectively transmit the rotating force of the motor and then transfer the rotating force to the rotating shaft 130. Reference symbol 180 denotes a fastening means configured to fasten the feet of the experiencing person to the horizontal bar.

An experiencing person rides on the swing-type experience apparatus in the state of standing on the horizontal bar 140 and holding the vertical bars 150 with his or her hands. Hereinafter, some terms will be defined for ease of description. In the claims and detailed description of the present application, the term "forward" refers to being in the direction in front of an experiencing person which the experiencing person faces in the state of being aboard the swing-type experience apparatus, and the term "rearward" refers to being in the direction in back of an experiencing person in the state in which the experiencing person is aboard the swing-type experience apparatus. Furthermore, the rotating shaft may be rotated in forward and reverse directions. In this case, the term "forward direction" refers to the direction in which the vertical bars are rotated to a location in front of the experiencing person, i.e., the frontward direction in which the vertical bars are rotated, and the term "reverse direction" refers to the direction in which the vertical bars are rotated to a location in back of the experiencing person, i.e., the backward direction in which the vertical bars are rotated.

In the present invention, acceleration is performed by selectively transmitting the power of the motor, rotating in the forward direction, to the rotating shaft through the clutch connected to the shaft of the motor. A powder clutch using a powder (a magnetic iron powder) is applied as the clutch of the present invention in order to control the rotating force transfer torque of the motor and to generate stable torque.

Furthermore, an encoder configured to detect the rotating direction of the rotating shaft is provided on the rotating shaft. In other words, a control algorithm is implemented to measure the rotating direction of the rotating shaft by using the encoder attached to one end of the rotating shaft and to control the rotation speed of the rotating shaft and acceleration timing. The ON/OFF timing of the clutch for acceleration is determined based on the rotating direction of the rotating shaft.

Figure 5:
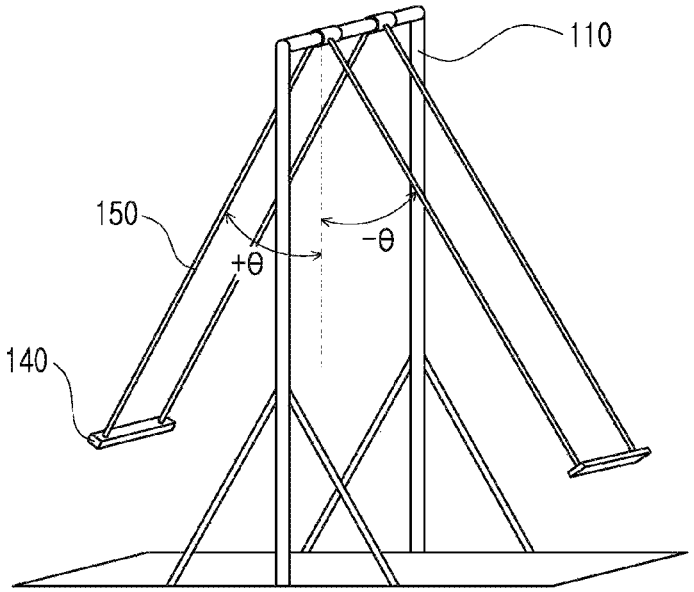
FIGS. 5 to 7 are views illustrating a method of controlling a swing-type experience apparatus according to an embodiment of the present invention.
Figure 6:
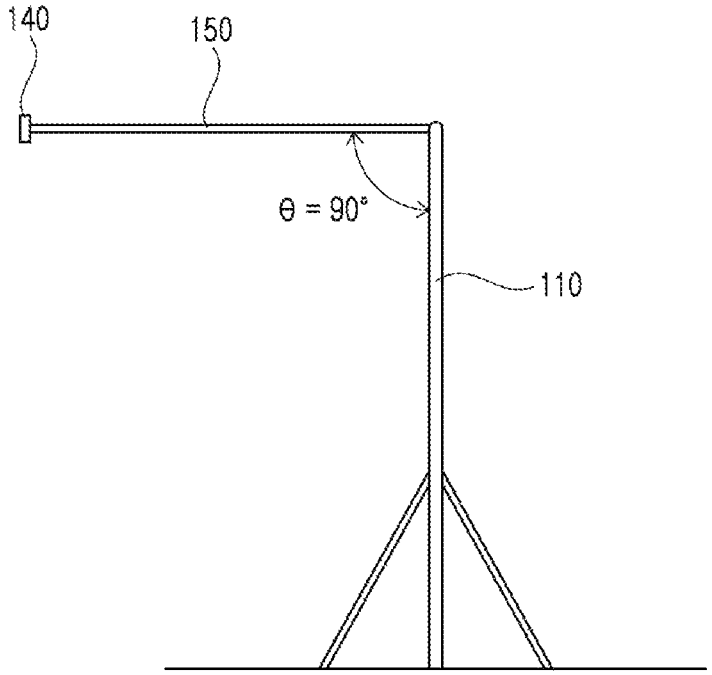
Figure 7:
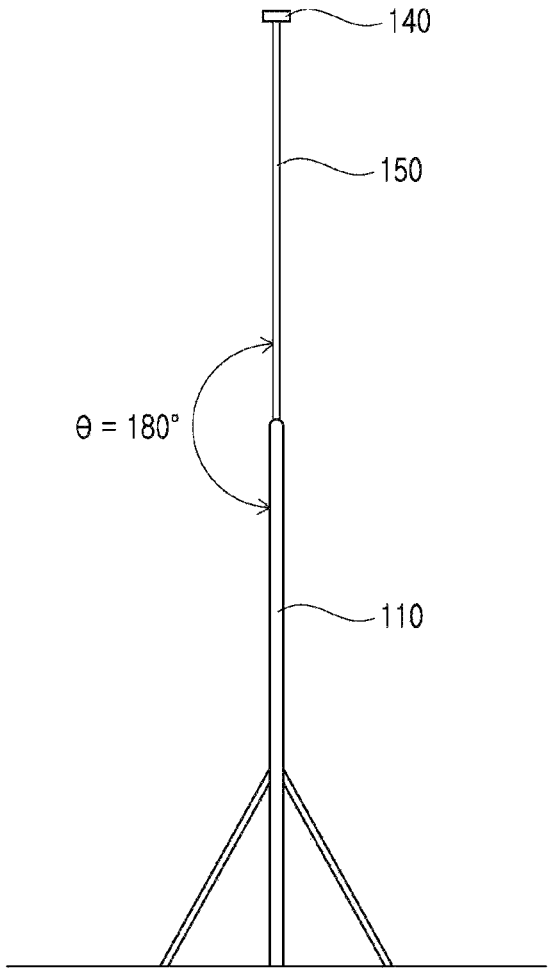
Figure 8:
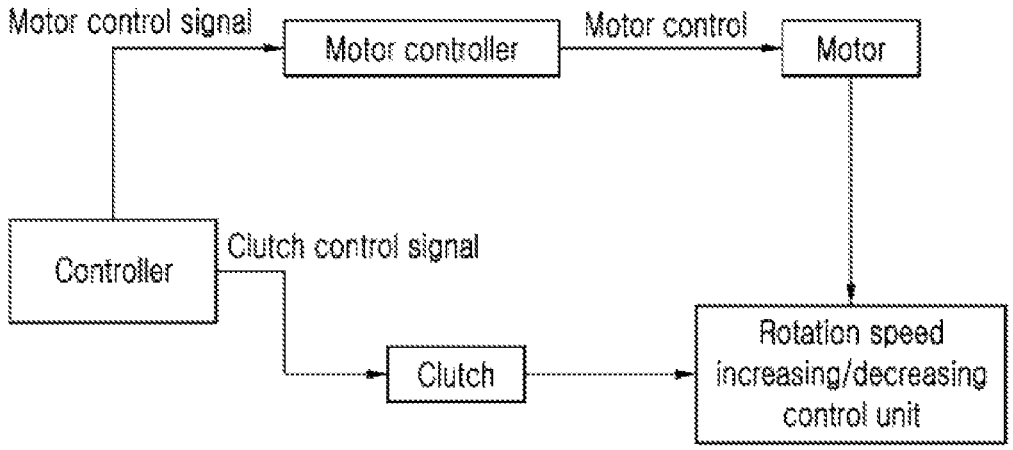
FIG. 8 is a view showing the configuration of a system for controlling a swing-type experience apparatus according to an embodiment of the present invention.

FIGS. 5 to 7 are views illustrating a method of controlling a swing-type experience apparatus according to an embodiment of the present invention, and FIG. 8 is a view showing the configuration of a system for controlling a swing-type experience apparatus according to an embodiment of the present invention. The control method according to the present invention will be described with reference to FIGS. 5 to 7 below.

The method of controlling a swing-type experience apparatus according to the present invention includes: a help mode in which the power of the motor is selectively transferred to the rotating shaft and thus an experiencing person feels the power transferred from the outside; and a non-help mode in which power is not transferred from the outside and thus an experiencing person is rotated by its own weight and inertia of a rotating body including the experiencing person and the rotating shaft. In other words, the help mode is the process of being assisted by the power of the motor for rotating force, and the non-help mode is the process of not being assisted by the power of the motor for rotating force.

In other words, the help mode is a mode of a process in which the rotating force of the driving device 120 is selectively transferred to the rotating shaft 130 through the clutch and, thus, the rotation angle of the rotating shaft increases gradually and the angle which is experienced by the experiencing person increases. Furthermore, the non-help mode is a process in which the rotating force of the driving device is not transferred to the rotating shaft and the rotating shaft is rotated by its own weight and inertia, in which case the experiencing person does not receive the assistance of external force (the motor) at all.

In this case, referring to FIG. 5, the angle which the vertical bars 150 form with a direction perpendicular to the ground is defined as θ. When the state in which the vertical bars 150 hang from the rotating shaft 130 and remain still before an experiencing person rides on the experience apparatus is set as an initial state, θ=0° in the initial state. In this state, an experiencing person rides on the experience apparatus. Thereafter, a positive value is assigned to θ in the case where the vertical bars are moved forward (in the direction in front of the experiencing person) from the initial state, while a negative value is assigned to θ in the case where the vertical bars are moved rearward from the initial state.

In the help mode, a clutch ON step and a clutch OFF step are repeated, and thus the power of the motor is transferred to the rotating shaft. In other words, the encoder (not shown) configured to detect the forward and reverse directions of the rotating shaft is provided on the rotating shaft of the present invention. When the rotating direction of the rotating shaft detected by the encoder is a forward direction, the clutch ON step of the help mode is performed. In contrast, when the rotating direction of the rotating shaft detected by the encoder is a reverse direction, a clutch OFF step is performed. At the clutch ON step, the clutch is turned on, the rotating force of the motor is transferred to the rotating shaft, and the rotating shaft is accelerated. At the clutch OFF step, the clutch is turned off, and the rotating force of the motor is transferred to the rotating shaft.

In the swing-type experience apparatus, when the rotating shaft is rotated in the forward direction, the clutch ON step is performed, and thus the rotating force of the motor is transferred to the rotating shaft. It is necessary to set a limit so that the rotating shaft is not accelerated continuously. In the present invention, the limit is set to the moment the vertical bars become parallel to the ground surface, i.e., the moment the value of θ reaches 90°. In other words, as soon as the vertical bars are rotated in the forward direction and the value of θ reaches 90°, the clutch ON step of the help mode is released and then the current step is switched to the clutch OFF step, so that the power of the motor is prevented from being transmitted no longer.

The moment the clutch ON step is released and the current step is switched to the clutch OFF step may vary in various manners by taking into consideration the conditions of the experiencing person and the experience apparatus. In other words, the clutch ON step of the help mode may be released as soon as the value of θ reaches a first specific value, and then the current step may be switched to the clutch OFF step. The help mode may be released as soon as the value of θ reaches a second specific value, and then the current mode may be switched to the non-help mode. The first specific value and the second specific value may vary depending on the situation. The first specific value may be set to any value which falls within the range of 45° to 90°.

Furthermore, the swing-type experience apparatus of the present invention allows an experiencing person to have an experience of 360° rotation. Accordingly, when the experiencing person is rotated once in the swing-type experience apparatus, the help mode itself is released and the current mode is switched to the non-help mode, so that the moment a single experience is terminated is determined. In other words, the help mode is released as soon as the value of θ reaches 180°, and then the current mode is switched to the non-help mode. Thereafter, the repeated operation of the swing is performed by their own inertia and weight of the experiencing person and the experience apparatus, and is then stopped. In this stopping process, the clutch may be turned on in a state in which the motor has been stopped, and a deceleration process may be performed.

If the experiencing person desires a re-experience after the termination of one experiment through the above-described process, an operator re-operates the above-described experience process (the help mode) through operation, thereby repeating the experience process again.

While the preferred embodiments of the present invention have been described in detail above, the scope of the present invention is not limited thereto. Various alterations and modifications using the basic concept of the present invention defined in the following claims, which are made by those skilled in the art, also fall within the scope of the present invention.

The invention claimed is:

1. A swing-type experience apparatus comprising:

two vertical columns (110) configured to be vertically installed into a ground;

a driving device (120) configured to be provided at an upper end of any one of the two vertical columns;

a rotating shaft (130) configured to be provided at upper ends of the two vertical columns in a lateral direction and to be rotated by the driving device;

two vertical bars (150) configured such that one end of each thereof is fastened to the rotating shaft and a remaining end of each thereof is connected to a horizontal bar (140);

wherein the driving device comprises a motor (121) and a clutch (125) configured to selectively transmit rotating force of the motor and then transfer the rotating force to the rotating shaft (130);

the clutch is a powder clutch using a magnetic iron powder;

an encoder configured to detect a rotating direction of the rotating shaft is provided on the rotating shaft;

the apparatus is configured to operate in a help mode in which the rotating force of the driving device is selectively transferred to the rotating shaft through the clutch, and a non-help mode in which the rotating shaft is rotated by its own weight and inertia without the rotating force of the driving device being transferred to the rotating shaft; and the apparatus is further configured to, when an angle which the vertical bars (150) form with a direction perpendicular to the ground is defined as θ, release the help mode as soon as a value of θ reaches 180° and switch a current mode to the non-help mode.

* * * * *